United States Patent [19]

Nakase

[11] Patent Number: 4,744,322

[45] Date of Patent: May 17, 1988

[54] REMOTE STEERING SYSTEM FOR MARINE PROPULSION CRAFTS

[75] Inventor: Ryoichi Nakase, Hamamatsu, Japan

[73] Assignee: Sanshin Kogyo Kabushiki Kaisha, Hamamatsu, Japan

[21] Appl. No.: 875,633

[22] Filed: Jun. 18, 1986

[30] Foreign Application Priority Data

Jun. 19, 1985 [JP] Japan ..... 60-133772

[51] Int. Cl.[4] ..... B63H 25/00

[52] U.S. Cl. ..... 114/144 E; 440/6

[58] Field of Search ..... 440/1, 2, 6, 61, 63, 440/7, 84; 114/144 RE; 200/157; 318/588

[56] References Cited

U.S. PATENT DOCUMENTS

| | | | |
|---|---|---|---|
| 2,667,746 | 2/1954 | Kumpf et al. | 114/144 R |
| 3,807,345 | 4/1974 | Peterson | 440/7 |
| 3,867,600 | 2/1975 | Phillips | 200/157 |
| 4,231,310 | 11/1980 | Muramatsu | 114/144 E |
| 4,419,084 | 12/1983 | Borst | 440/63 |

*Primary Examiner*—Joseph F. Peters, Jr.
*Assistant Examiner*—Jesûs D. Sotelo
*Attorney, Agent, or Firm*—Ernest A. Beutler

[57] ABSTRACT

Several embodiments of improved mechanisms for controlling an outboard drive of a marine watercraft. In each embodiment, there is provided a hand held control unit that permits remote steering and engine control of the watercraft. In some embodiments, the hand held control includes a rotatable control element for effecting steering and a reciprocating control element for killing the engine. In some embodiments, the controls for the engine and steering are designed to be operated by different fingers of the user and in other embodiments, they are designed so as to be operated by the same finger of the operator. In addition, there is included an improved sensor for sensing the steered position of the outboard drive.

6 Claims, 4 Drawing Sheets

Fig-4
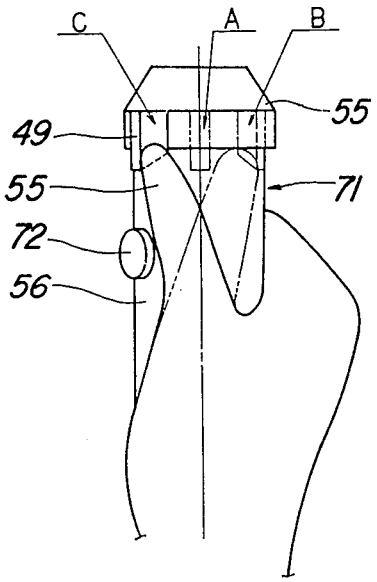
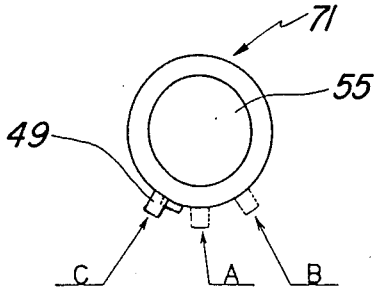
Fig-5
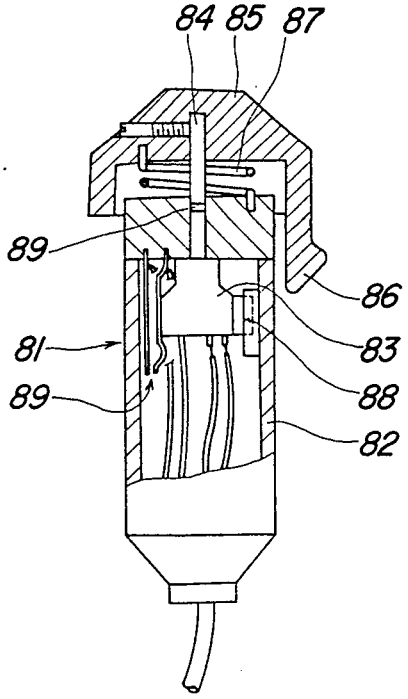
Fig-6

REMOTE STEERING SYSTEM FOR MARINE PROPULSION CRAFTS

BACKGROUND OF THE INVENTION

This invention relates to a remote steering system for marine propulsion crafts and more particularly to an improved control for steering of an outboard drive and also controlling the powering engine and to an improved arrangement for indicating the steered position of the outboard drive.

In many forms of marine propulsion arrangements, the watercraft is steered by pivoting the outboard drive about a vertically extending axis so as to effect rotation of the propulsion unit and to steer the watercraft. This type of steering arrangement is conventionally employed in both outboard motors and in the outboard drive portion of an inboard/outboard drive. It has been proposed to provide a control for such outboard drives wherein the operator may set the desired angular position through a remote setting device and also wherein the operator may override that setting of the outboard drive through a manually operated steering control. Such an arrangement is shown in the copending application entitled "Marine Steering Apparatus", Ser. No. 864,444, filed May 16, 1986, in the names of Ryoichi Nakase and Masayoshi Nanami, and assigned to the assignee of this application.

Frequently, the position setting device is a very small unit that can be held in the hand of an operator and thus affords the opportunity for the operator to control the watercraft from any of a plurality of locations. The operator may steer the outboard drive by manipulating this hand held unit, particularly to provide steering in emergency conditions. However, the types of devices previously proposed only permit the operator to steer the outboard drive from this location and hence do not afford the degree of control which may be desired under some circumstances.

It is, therefore, a principal object of this invention to provide an improved remote control system for an outboard drive wherein both steering and the propulsion unit may be controlled from a hand held unit.

It is a further object of this invention to provide an improved and compact remote control device for an outboard drive that may be held in the hand of an operator and which permits both steering of the outboard drive and stopping of its propulsion unit.

In connection with the steering systems for outboard drives and particularly those embodying a remote control, it is desirable, if not necessary, to incorporate a sensing device for indicating the steered position of the outboard drive. By its very nature, the sensing device requires a pair of relatively movable elements that provide a sensing signal and one of these elements must be fixed for movement with the outboard drive upon its steering while the other of the elements must be fixed relative to the associated watercraft. Such sensing devices must also accommodate the fact that it is conventional to tilt the outboard drive about a horizontally extending tilt axis. The sensing device should accommodate such tilting movement and not interfere with it. In addition, the tilting movement should not affect the signal transmitted by the sensing device. That is, the sensing device should not provide an indication of a change in steering condition merely because the outboard drive has been tilted about its tilt axis.

It is, therefore, a still further object of this invention to provide an improved device for sensing the steered position of an outboard drive.

It is a further object of this invention to provide a compact and highly reliable device for indicating the steered position of an outboard drive.

It is a yet further object of the invention to provide a steering position sensor for an outboard drive that will accommodate tilting movement of the outboard drive about a horizontally disposed tilt axis.

SUMMARY OF THE INVENTION

A feature of this invention is adapted to be embodied in a marine control apparatus having an outboard drive supported for steering movement upon an associated watercraft and powered by an engine. A first steering mechanism is adapted to be affixed in the watercraft for effecting control of the steering movement of the outboard drive. In accordance with the invention, a hand held control unit is provided for the engine and for steering the outboard drive and comprises an element which is sized to be held in the hand of an operator. A steering control is carried by this element and is movable between a plurality of control positions. Means are provided for transmitting a control signal for steering of the outboard drive in response to the position of the steering control. An engine control is also carried by the element and is movable to a control position. Means transmit a control signal from the engine control to the engine for controlling the engine.

Another feature of this invention is adapted to be embodied in an outboard drive that is adapted to be mounted on the transom of a watercraft for steering movement about a generally vertically extending steering axis and tilting movement about a generally horizontally extending tilt axis. In accordance with this feature of the invention, sensing means are provided for giving a signal indicative of the angle of the outboard drive about the steering axis. The sensing means comprises a pair of relatively movable elements that provide a signal in response to the relative positions. Means are provided for affixing one of the elements against movement relative to the outboard drive and for effecting movement of the other of the elements upon steering movement of the outboard drive. The elements are relatively movable along a horizontal line.

Yet another feature of this invention is adapted to be embodied in a marine outboard drive as set forth in the preceding paragraph and having a sensing element that is comprised of a pair of relatively movable elements. In accordance with this feature, the elements are pivotal with the outboard drive about the horizontally tilt axis.

BRIEF DESCRIPTION OF THE DRAWINGS

FIG. 4 is a side elevational view of a remote controller constructed in accordance with another embodiment of the invention.

FIG. 5 is a top plan view of the remote controller shown in FIG. 4.

FIG. 6 is a side elevational view, with a portion broken away, of a remote controller constructed in accordance with a still further embodiment of the invention.

DETAILED DESCRIPTION OF THE PREFERRED EMBODIMENTS

Figure 1:
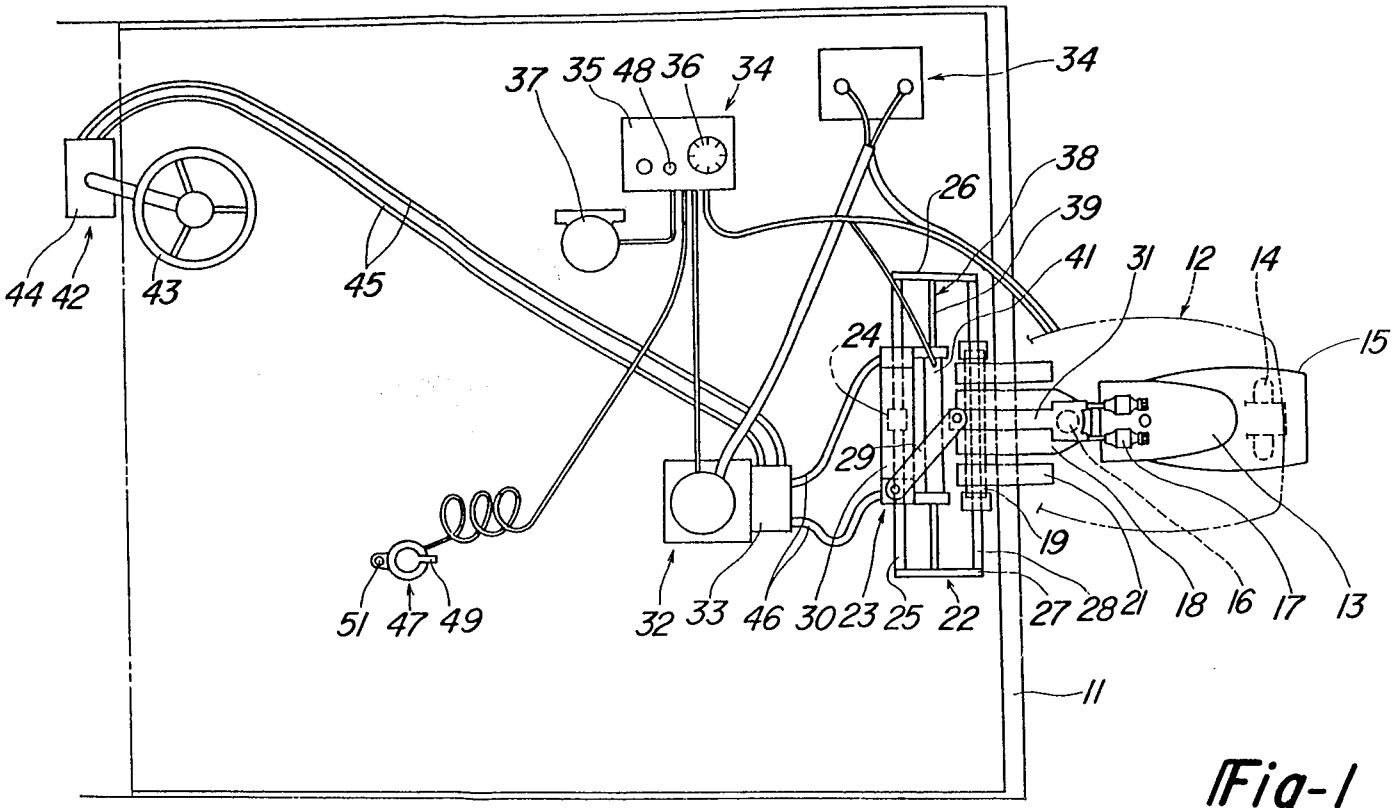
FIG. 1 is a partially schematic top plan view of a watercraft powered by an outboard drive and controlled in accordance with a first embodiment of the invention, with portions shown in phantom.

Referring first to FIG. 1, a watercraft is identified generally by the reference numeral 11 and is adapted to include a remote control mechanism embodying the invention. The watercraft 11 is powered by means of an outboard motor, indicated generally by the reference numeral 12, and shown in phantom in this view. Although the invention is described in conjunction with an outboard motor, it is to be understood that the invention may also be employed in connection with an inboard/outboard drive. The outboard motor 12 includes a power head, which is shown in phantom, and which drives a drive shaft that is contained within a drive shaft housing 13. The drive shaft, in turn, drives a propeller 14 of a lower unit 15 for propelling the watercraft 11 through the water.

A steering shaft 16 is affixed to the drive shaft housing 13 by means of a supporting assemblage 17 and is rotatably journaled in a swivel bracket 18. As such, the outboard motor 12 may be steered about a vertically extending steering axis defined by the steering shaft 16.

The swivel bracket 18 is, in turn, supported by means of a pivot pin 19 upon a clamping bracket 21 for tilting movement of the outboard motor 12 about a horizontally extending tilt axis. The clamping bracket 21 is, in turn, adapted to be affixed to the transom of the watercraft 11 in a known manner. The construction of the outboard motor 12 and its association with the watercraft 11 as thus far described may be considered to be conventional and may employ any of the known type of constructions. In addition, rather than employing an outboard motor 12, it is to be understood that the invention could be used in conjunction with an inboard/outboard drive wherein the outboard drive is mounted in a generally similar manner on the transom of the watercraft 11 and the application of the invention to such an arrangement is believed to be readily apparent to those skilled in this art.

A mechanism, indicated generally by the reference numeral 22, is provided for effecting powered steering of the outboard motor 12. This steering mechanism is of the type as described in the aforenoted application Ser. No. 864,444. Specifically, the steering mechanism includes a linear type fluid motor 23 that includes a cylinder 30 which has an internal bore in which a piston 24 is received. The piston 24 is, in turn, affixed to a through piston rod 25. The opposite ends of the piston rod 25 are connected rigidly to a pair of brackets 26 and 27 which are, in turn, affixed to a parallel rod 28 that is supported within the pivot pin 19 and which may pivot along with the swivel bracket 21 in an appropriate manner.

The cylinder 30 of the fluid motor 23 is pivotally connected to one end of a link 29. The opposite end of the link 29 is pivotally connected to a steering lever 31 which is affixed to the steering shaft 16 so that reciprocating movement of the cylinder 30 of the fluid motor 23 will effect pivotal or steering movement of the outboard motor 12.

The fluid motor 23 is actuated by means of an electrically driven fluid pump, indicated generally by the reference numeral 32, which actuates the fluid motor 23 through a control valve assembly 33 of the type generally shown in application Ser. No. 864,444. The electrically operated pump 32 receives its power from a battery 34. The electrically driven pump 32 is operated by means of an automatic steering control, indicated generally by the reference numeral 34. The automatic steering control 34 includes a controller box 35 and which has a manually settable steering control element 36 by which the operator may set either the desired steering angle or a course. If this latter embodiment is employed, a magnetic compass 37 is provided which also has an input to the control box 35.

A feedback circuit for the actual steering position of the outboard motor 12 is provided which includes a steering angle sensor mechanism, indicated generally by the reference numeral 38. This includes a rod 39 that is affixed to the brackets 26 and 27 and which includes a sensor 41 that is coupled for movement with the fluid motor cylinder 30 so as to provide a signal indicative of the position of the fluid motor cylinder 30 and, accordingly, the steered position of the outboard motor 12. The sensor mechanism 38 may be a linear type of resistor having a movable element that is carried by the sensor 41 and movable with it and a fixed element that is affixed to the rod 39 so as to provide an output signal indicative of the position of the sensor 41 relative to the rod 39. This automatic steering control mechanism may be of any known type, for example, that shown in the aforenoted copending application Ser. No. 864,444.

There is also provided a manual steering system for the outboard motor which is indicated generally by the reference numeral 42 and includes a steering wheel 43. The steering wheel 43 controls a manual steering pump 44 that is connected by means of a pair of fluid lines 45 to the valve assembly 33. The output from the valve assembly 33 to the opposite ends of the fluid motor 23 is accomplished by means of a pair of conduits 46. The manner in which manual steering control can operate the steering position of the outboard motor 12 is, as with many other elements of the steering mechanism, as described in conjunction with the arrangement shown in copending application Ser. No. 864,444.

In order to permit further remote steering of the outboard motor 12 and control of it, there is provided a further handy remote controller, indicated generally by the reference numeral 47 and which is operative to provide an input signal to the control box 35 for actuating its steering mechanism. There is provided a selector switch 48 on the control box 35 so that the operator may select control by either the remote controller 47 or by the control element 36. The remote controller 47 permits the operator to steer the watercraft 11 from a location other than that of the automatic control 34 or steering wheel 43 and thus offers greater versatility for the watercraft. The remote controller 47 has a control lever 49 for setting the steering position of the outboard motor 12 and also an engine control or kill switch 51 so as to permit the operator to stop the powering engine of the outboard motor 12 or an inboard mounted engine of an inboard/outboard arrangement. The electrical circuit for accomplishing this engine killing will be described in conjunction with FIG. 7. Although engine killing operation is described, it is to be understood that other types of engine control may be provided.

Figure 2:
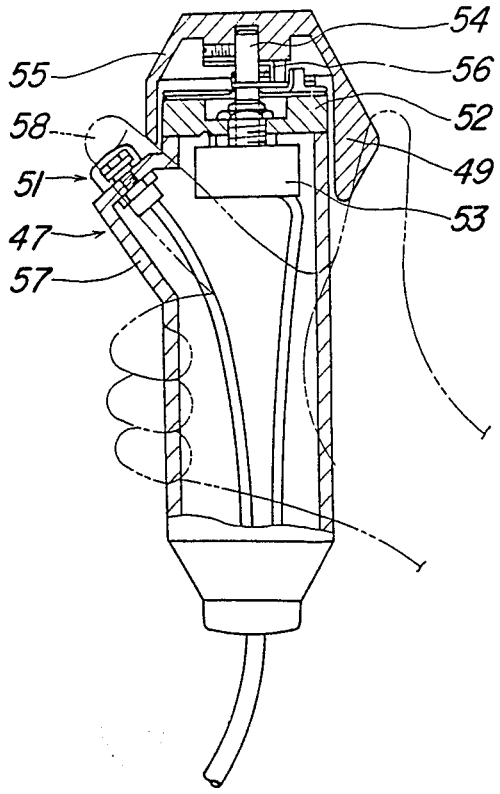
FIG. 2 is a side elevational view, with a portion broken away, of the remote controller employed in the embodiment of FIG. 1.
Figure 3:
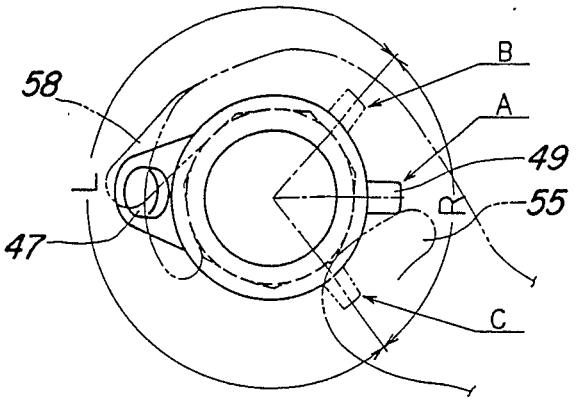
FIG. 3 is a top plan view of this remote controller.

Referring now specifically to FIGS. 2 and 3, one embodiment of a handy remote controller 47 is illustrated. The remote controller 47 includes a main body portion 52 which is sized and shaped so as to be conveniently held within an operator's hand as indicated in phantom in FIG. 2. Contained within the body portion 52 is a control element such as a rheostat 53 that functions in a similar manner to the setting plate 36 of the automatic steering control 34 so as to provide an input signal indicative of the desired angular position of the outboard motor 12 about its steering axis 16.

The rheostat 53 is provided with a shaft 54 to which is affixed a knob portion 55 from which the steering control lever 49 depends. The steering control lever 49 is designed so that it will be juxtaposed to the thumb of the operator who is gripping the housing 52 so that the operator may conveniently steer the outboard motor by manipulation of his thumb. The thumb is shown in phantom in the figures and is identified by the reference numeral 55. A torsional spring assembly 56 encircles the shaft 54 and operates so as to urge the steering control lever to a null or neutral position as indicated by the arrow A in FIG. 3. The full range of steering movement is indicated by the arrows B and C so that it can be understood that the steering movement through the full range is accomplished by relatively minor thumb movement of the operator.

The housing 56 also includes a forwardly extending protuberance 57 that contains and supports the engine control 51. In this embodiment, the engine control 51 is located adjacent the normal position of the operator's first finger, indicated in phantom at 58.

A handy remote controller constructed in accordance with another embodiment of the invention is illustrated in FIGS. 4 and 5 and is identified generally by the reference numeral 71. This embodiment differs from the previously described embodiment only in the manner of mounting the engine control and its location for operation by the operator. For that reason, the components of the remote controller 71 which are the same as the previously described embodiment (FIGS. 2 and 3) have been identified by the same reference numerals and will not be described again in detail.

In this embodiment, an engine kill switch, indicated generally by the reference numeral 72, is mounted on the housing 56 in proximity to one of the extreme steering positions of the steering controller 49 (the position indicated by the arrow C) so that the operator may conveniently kill the engine with his thumb 55 by depressing the engine kill switch 72 as should be readily apparent from the figures.

In each of the embodiments as thus far described, the engine control and steering control have been by separate elements. In FIG. 6, a handy remote controller constructed in accordance with a further embodiment of the invention is identified generally by the reference numeral 81. In this embodiment, a single control element is operative to control both steering and engine control although the control movements are in different senses, as will be described. In this embodiment, the controller 81 includes an outer housing 82 in which the steering control rheostat 83 is mounted. The steering control rheostat 83 includes a shaft 84 which is connected to a knob 85 that has a depending steering control portion 86 which, as in the previously described embodiments, is operative to control the steering of the outboard motor and which is juxtaposed to the operator's thumb. A coil compression and tension spring 87 encircles the shaft 84 and urges the steering control 86 to a null position.

In this embodiment, the rheostat 83 is supported for sliding movement within the housing 82 but is keyed against rotation relative to the housing by a tongue and groove arrangement 88. The rheostat 83 has its outer housing disposed so that it can engage a contact of a switch 89 for closing this switch to control engine killing. This is accomplished by pushing the control knob 85 downwardly against the action of the coil spring 87 and to release a detent mechanism 89 of a known type. Hence, in this embodiment, the steering and engine control are achieved by means of the same control knob.

Figure 7:
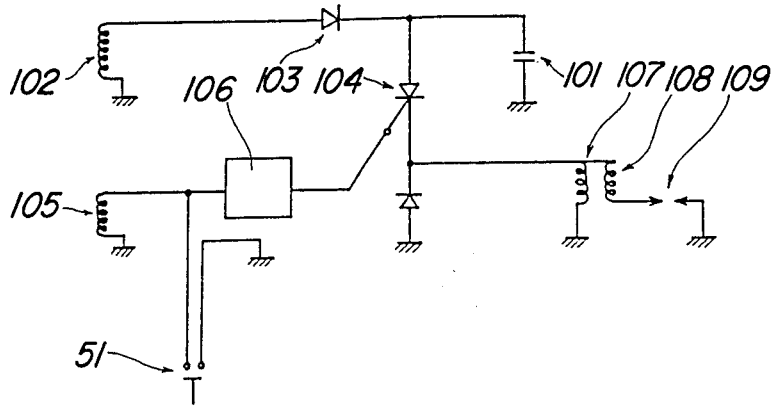
FIG. 7 is a schematic electrical diagram showing the manner of engine control in each of the embodiments.

The circuit for controlling the engine is illustrated in FIG. 7, although it is to be understood that other types of engine control circuits may be employed, as will be readily apparent to those skilled in the art. The circuit is employed in conjunction with a conventional capacitor discharge ignition system (CDI) that includes a capacitor 101 that is charged from a charging coil 102 through a rectifying diode 103. The charging coil 102 is positioned in proximity to the flywheel of the engine and is energized, in a known manner, by a rotating magnet.

An SCR 104 is provided for discharging the capacitor 101 to the ground and the SCR 104 has its gate controlled by a pulser coil 105 that outputs through a control circuit 106 of a known type. When the SCR 104 is rendered conductive, a voltage will be induced in a primary winding 107 of an ignition coil so as to induce a stepped up voltage in the secondary coil 108 so as to fire a spark plug, indicated schematically at 109.

The engine control, for example, the engine control 51 of the embodiment of FIGS. 2 and 3, is operative to provide a grounding circuit for the pulser coil 105 so as to prevent energization of the circuit 106 and gating of the SCR 104 so as to prevent discharge of the capacitor 101 and, accordingly, firing of the spark plug 109 so as to kill the engine. As has been previously discussed, other types of engine control may be employed.

It should be readily apparent from the foregoing description that a number of improved remote controllers have been illustrated and described which permit the watercraft operator not only to control the steering of a marine propulsion device but also so as to control its driving engine. Although a number of embodiments have been illustrated and described, various changes and modifications may be made without departing from the spirit and scope of the invention, as defined by the appended claims.

I claim:

1. In a marine control apparatus having an outboard drive supported for steering movement upon an associated watercraft, an engine for powering said outboard drive, a first steering mechanism adapted to be affixed in the watercraft for effecting control of the steering movement of said outboard drive, the improvement comprising a hand held control unit for said engine and for steering said outboard drive comprising an element sized to be held in the hand of an operator, a steering control carried by said element and movable between a plurality of control positions, means for transmitting a control signal for steering said outboard drive in response to the position of said steering control, an engine control carried by said element and movable to a control position, and means for transmitting a control signal from said engine control to the engine for controlling the engine, said steering control and said engine control comprising a common control element that operates both said steering control and said engine control.

2. In a marine control apparatus as set forth in claim 1 wherein the common control element is rotatable for steering control and reciprocal for engine control.

3. In a marine control apparatus as set forth in claim 1 further including automatic steering control adapted to be mounted at a fixed location within the watercraft for effecting control of the steering movement of the outboard drive and further including means for permitting operator selection of steering by either the automatic steering control or the steering control of the hand held control unit.

4. In a marine control apparatus as set forth in claim 3 wherein the common control element is rotatable for steering control and reciprocal for engine control.

5. In a marine control apparatus having an outboard drive supported for steering movement upon an associated watercraft, an engine for powering said outboard drive, a first steering mechanism adapted to be affixed in the watercraft for effecting control of the steering movement of said outboard drive, the improvement comprising a hand held control unit for said engine and for steering said outboard drive comprising an element sized to be held in the hand of an operator, a steering control carried by said element and movable between a plurality of control positions, means for transmitting a control signal for steering said outboard drive in response to the position of said steering control, an engine control carried by said element and movable to a control position, and means for transmitting a control signal from said engine control to the engine for controlling the engine, said outboard drive being supported for tilting movement about a horizontally extending tilt axis and further including sensor means for providing a signal indicative of the steered angle of the outboard drive comprising a pair of relatively movable elements providing a signal in relation to their relative positions, means for affixing one of the elements against movement relative to the outboard drive, and means for effecting movement of the other of said elements upon steering movement of said outboard drive, said elements being relatively movable along a horizontal line.

6. In a marine control apparatus having an outboard drive supported for steering movement upon an associated watercraft, an engine for powering said outboard drive, a first steering mechanism adapted to be affixed in the watercraft for effecting control of the steering movement of said outboard drive, the improvement comprising a hand held control unit for said engine and for steering said outboard drive comprising an element sized to be held in the hand of an operator, a steering control carried by said element and movable between a plurality of control positions, means for transmitting a control signal for steering said outboard drive in response to the position of said steering control, an engine control carried by said element and movable to a control position, and means for transmitting a control signal from said engine control to the engine for controlling the engine, said outboard drive being supported for tilting movement about a horizontally extending tilt axis and further including sensor means for providing a signal indicative of the steered angle of the outboard drive comprising a pair of relatively movable elements providing a signal in relation to their relative positions, means for affixing one of the elements against movement relative to the outboard drive, and means for effecting movement of the other of said elements upon steering movement of said outboard drive, said elements being fixed for pivotal movement with the outboard drive about the horizontally extending tilt axis.

* * * * *